US008033167B2

(12) United States Patent
Miller

(10) Patent No.: US 8,033,167 B2
(45) Date of Patent: Oct. 11, 2011

(54) SYSTEMS AND METHODS FOR PROVIDING A CATALYST

(76) Inventor: Gary Miller, Phoenix, AZ (US)

( * ) Notice: Subject to any disclaimer, the term of this patent is extended or adjusted under 35 U.S.C. 154(b) by 426 days.

(21) Appl. No.: 12/391,971

(22) Filed: Feb. 24, 2009

(65) Prior Publication Data

US 2010/0212415 A1 Aug. 26, 2010

(51) Int. Cl.
*G01M 15/04* (2006.01)

(52) U.S. Cl. ..... 73/114.75; 123/670

(58) Field of Classification Search ..... 73/114.75; 123/670; 239/338

See application file for complete search history.

(56) References Cited

U.S. PATENT DOCUMENTS

| | | | |
|---|---|---|---|
| 1,336,905 | A | 4/1920 | Hunzicker |
| 1,989,113 | A | 1/1935 | Rector |
| 2,086,775 | A | 7/1937 | Lyons |
| 2,460,700 | A | 2/1949 | Lyons |
| 3,615,836 | A | 10/1971 | Batzold |
| 3,790,139 | A | 2/1974 | Stephenson |
| 3,800,768 | A | 4/1974 | Rhodes |
| 3,856,901 | A | 12/1974 | Neumann |
| 3,862,819 | A | 1/1975 | Wentworth, Jr. |
| 3,875,922 | A | 4/1975 | Kirmss |
| 3,929,118 | A | 12/1975 | Leong |
| 3,940,923 | A | 3/1976 | Pfefferle |
| 4,076,002 | A | 2/1978 | Mellqvist |
| 4,090,838 | A | 5/1978 | Schena |
| 4,100,235 | A | 7/1978 | Thornwald |
| 4,109,461 | A | 8/1978 | Fujitani |
| 4,157,316 | A | 6/1979 | Thompson |
| 4,170,200 | A | 10/1979 | Takeuchi |

(Continued)

FOREIGN PATENT DOCUMENTS

| | | |
|---|---|---|
| WO | WO 01/51800 | 7/2001 |

OTHER PUBLICATIONS

International Search Report and Written Opinion for PCT/US2009/035029.

*Primary Examiner* — Freddie Kirkland, III

(74) *Attorney, Agent, or Firm* — Letham Law Firm LLC; Lawrence Letham

(57) ABSTRACT

A system for providing a catalyst to a first flow of gas. The first flow of gas has an operating pressure. A pipe carries the first flow of gas from a compressor of a turbocharger to a combustion chamber. The operating pressure of the first flow of gas varies in accordance with an operation of the compressor. The system includes an enclosure, a pump, and an atomizer. The enclosure receives a portion of the first flow of gas at the operating pressure. The pump is positioned in the enclosure. The pump receives from within the enclosure the portion of the first flow of gas. The pump provides the portion of the first flow of gas at a second pressure. Any gas that exits the enclosure is provided by the pump at the second pressure. The atomizer receives a solution having the catalyst and provides a vapor having the catalyst. The portion of the first flow of gas at the second pressure carries the vapor out of the system and into the first flow of gas for delivery to the combustion chamber. A magnitude of the second pressure comprises a magnitude of the operating pressure plus a magnitude of a pressure increase provided by the pump.

21 Claims, 5 Drawing Sheets

U.S. PATENT DOCUMENTS 4,170,960 A 10/1979 Germack
4,235,754 A 11/1980 Chester
4,295,816 A 10/1981 Robinson
4,362,130 A 12/1982 Robinson
4,382,017 A 5/1983 Robinson
4,404,804 A 9/1983 Tadokoro
4,406,784 A 9/1983 Cochran
4,410,467 A 10/1983 Wentworth, Jr.
4,440,874 A 4/1984 Thompson
4,475,483 A 10/1984 Robinson
4,493,637 A 1/1985 Ganter
4,538,981 A 9/1985 Venturini
4,579,653 A 4/1986 Davis
4,629,472 A 12/1986 Haney, III et al.
4,725,222 A 2/1988 Koch
4,725,226 A 2/1988 Balsiger
4,802,335 A 2/1989 Bidwell
4,811,753 A 3/1989 Bethune
5,085,841 A 2/1992 Robinson
5,149,433 A 9/1992 Lien
5,199,386 A * 4/1993 Hubbard ..... 123/25 E
5,283,052 A 2/1994 Hums
5,331,924 A 7/1994 Kraus
5,373,825 A 12/1994 Stephens
5,386,690 A 2/1995 Shustorovich
5,501,714 A 3/1996 Valentine
5,525,316 A 6/1996 Shustorovich
5,554,278 A 9/1996 Henderson
5,558,513 A 9/1996 Wentworth, Jr.
5,604,980 A 2/1997 Shustorovich
5,759,947 A 6/1998 Zhou
5,785,930 A 7/1998 Sinclair
5,839,290 A 11/1998 Nazeri
5,851,498 A 12/1998 Rozenshtein
5,907,950 A 6/1999 Enderle
5,924,280 A 7/1999 Tarabulski
5,968,464 A 10/1999 Peter-Hoblyn
5,976,475 A 11/1999 Peter-Hoblyn
6,013,599 A 1/2000 Manson
6,116,201 A 9/2000 LaBelle
6,129,897 A 10/2000 Neelakantan
6,159,383 A 12/2000 Gullett
6,176,701 B1 1/2001 Robinson
6,180,081 B1 1/2001 Poschmann
6,293,410 B1 9/2001 Forbes
6,296,196 B1 10/2001 Denen
6,302,144 B1 10/2001 Graham
6,371,087 B1 4/2002 Condran
6,419,477 B1 7/2002 Robinson
6,444,121 B1 9/2002 Maxwell
6,446,880 B1 9/2002 Schram
6,602,067 B1 8/2003 Robinson
6,698,412 B2 3/2004 Dalla Betta
6,739,126 B2 5/2004 Huthwohl
6,766,817 B2 7/2004 da Silva
6,776,606 B2 8/2004 Haskew
6,786,714 B2 9/2004 Haskew
6,843,966 B1 1/2005 Mahr
7,071,141 B2 7/2006 Gandhi
7,141,226 B2 11/2006 Twigg
7,165,393 B2 1/2007 Betta
7,220,289 B2 5/2007 Jordan
7,281,526 B2 10/2007 Keiichiro
7,481,045 B2 1/2009 Fayard
7,481,379 B2 1/2009 Cunningham
7,482,303 B2 1/2009 Bosteels
7,584,905 B2 * 9/2009 Cunningham et al. ..... 239/338
7,828,225 B2 * 11/2010 Cunningham ..... 239/4
2002/0150514 A1 * 10/2002 Haskew ..... 422/145
2002/0165088 A1 11/2002 Haskew
2003/0234012 A1 12/2003 Bosteels
2004/0118764 A1 6/2004 Miller
2004/0255874 A1 12/2004 Haskew
2005/0053875 A1 3/2005 Haskew
2005/0054522 A1 3/2005 Haskew
2006/0112906 A1 6/2006 Cunningham
2006/0156709 A1 7/2006 Twigg
2007/0277505 A1 12/2007 Dawson
2007/0281252 A1 12/2007 Haskew
2008/0066456 A1 3/2008 Schmieg
2008/0104949 A1 5/2008 Schmeichel
2008/0107592 A1 5/2008 Adams
2008/0141660 A1 6/2008 Kim
2008/0142287 A1 6/2008 Simmons
2008/0230018 A1 9/2008 Kobayashi
2008/0264047 A1 10/2008 Griffiths
2008/0265051 A1 10/2008 Theodorof
2009/0000281 A1 1/2009 Nakatsuji
2009/0013589 A1 1/2009 Aradi
2009/0019837 A1 1/2009 Suzuki

* cited by examiner

SYSTEMS AND METHODS FOR PROVIDING A CATALYST

FIELD OF THE INVENTION

Embodiments of the present invention relate to a system for providing a catalyst and in particular for providing a catalyst to a combustion chamber.

BACKGROUND OF THE INVENTION

A catalyst may modify a combustion reaction to provide a more desirable reaction (e.g., more complete, fewer waste byproducts). A catalyst may be provided to a combustion chamber (e.g., furnace, cylinder of an internal combustion engine) via a flow of gas. Catalyst delivery may benefit from a system that provides the catalyst via a flow of gas (e.g., air) that varies in pressure.

SUMMARY OF THE INVENTION

A system for providing a catalyst to a first flow of gas. The first flow of gas has an operating pressure. A pipe carries the first flow of gas from a compressor of a turbocharger to a combustion chamber. The operating pressure of the first flow of gas varies in accordance with an operation of the compressor. The system includes an enclosure, a pump, and an atomizer. The enclosure receives a portion of the first flow of gas at the operating pressure. The pump is positioned in the enclosure. The pump receives from within the enclosure the portion of the first flow of gas. The pump provides the portion of the first flow of gas at a second pressure. Any gas that exits the enclosure is provided by the pump at the second pressure. The atomizer receives a solution having the catalyst and provides a vapor having the catalyst. The portion of the first flow of gas at the second pressure carries the vapor out of the system and into the first flow of gas for delivery to the combustion chamber. A magnitude of the second pressure comprises a magnitude of the operating pressure plus a magnitude of a pressure increase provided by the pump.

A method for providing a catalyst to a first flow of gas. The first flow of gas has an operating pressure. A pipe carries the first flow of gas from a compressor of a turbocharger to a combustion chamber. The operating pressure of the first flow of gas varies in accordance with an operation of the compressor. The method includes in any practical order: (1) receiving a portion of the first flow of gas at the operating pressure; (2) increasing a pressure of the portion of the first flow of gas to a second pressure; (3) introducing the catalyst into the portion of the first flow of gas while the portion of the first flow of gas is at the second pressure; and (4) releasing the portion of the first flow of gas having the catalyst into the first flow of gas. A magnitude of the second pressure comprises the magnitude of the operating pressure plus a magnitude of the pressure increase.

A method for providing a catalyst to a first flow of gas. The first flow of gas has an operating pressure. A pipe carries the first flow of gas from a compressor of a turbocharger to a combustion chamber. The operating pressure of the first flow of gas varies in accordance with an operation of the compressor. The method includes in any practical order: (1) detecting a magnitude of the operating pressure; (2) in accordance with detecting, providing a second flow of gas at a second pressure; and (3) releasing the second flow of gas into the first flow of gas. The second flow of gas includes a portion of the first flow of gas. The second flow of gas includes the catalyst. A change in the magnitude of the operating pressure results in a corresponding change after a delay in the magnitude of the second pressure. After the delay: the magnitude of the second pressure comprises the magnitude of the operating pressure plus a threshold; and the magnitude of the second pressure is greater than the magnitude of the operating pressure.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
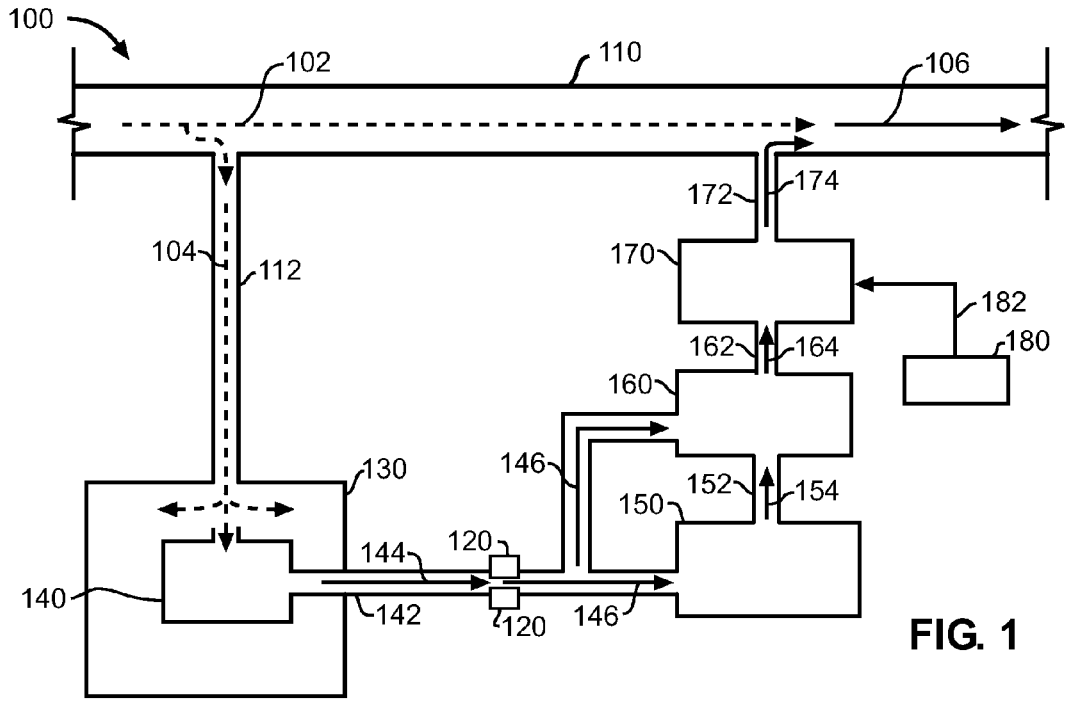
FIG. 1 is a functional block diagram of an system for providing a catalyst, according to various aspects of the present invention.

A system for providing a catalyst provides a catalyst for delivery (e.g., transport, transport, movement) to a location for performing a reaction (e.g., combustion chamber, reaction chamber). A system may provide a catalyst in combination with one or more reactants. A system may provide a catalyst separate from all reactants for introduction into a reaction chamber. A system may convert a catalyst from one state (e.g., solid, liquid, gas, plasma) to another state for delivery or use in a reaction. For example, a system may atomize (e.g., nebulize, vaporize) a liquid bearing a catalyst to provide a catalyst in a form of a vapor (e.g., aerosol, gas, spray, mist). A system may heat or cool a catalyst to effect a change of state.

Reactants may be provided to a reaction chamber under pressure (e.g., greater or less than atmospheric pressure). Delivery of a catalyst to a reaction chamber may be inhibited if the catalyst is delivered at a pressure less than the pressure of delivery of a reactant or a pressure of the reaction chamber. A system may provide a catalyst at a pressure greater than the pressure of delivery of a reactant or a pressure of a reaction chamber. A system may increase or decrease a magnitude of the pressure of delivery of the catalyst. A system may detect a pressure of delivery of a reactant or a pressure of a reaction chamber and increase or decrease a pressure of delivery of the catalyst in accordance with detecting.

A magnitude of the pressure used to deliver reactants may vary over time. A pressure of delivery of a reactant may vary with a rate of operation of a reaction chamber. A system may vary a pressure of delivery of a catalyst in accordance with a pressure of delivery of a reactant or a rate of operation of a reaction chamber.

For example, power plant 400 includes engine 440, turbocharger (e.g., supercharger, turbo, turbosupercharger) 410, intercooler 420, fuel tank 480, pump 482, inlet 402 and outlet 418. Exhaust gases exit exhaust manifold 450 of engine 440 at a pressure and pass through turbine 412 of turbocharger 410 before exiting outlet 418 to an exhaust system (e.g., muffler, catalytic converter, tail pipe). Turbine 412 spins compressor 414 of turbo charger 410. Compressor 414 compresses atmospheric air from inlet 402 and sends air (e.g., a reactant) at a pressure to a combustion chamber (e.g., cylinder), not shown, of engine 440 via pipe 416, intercooler 420, pipe 422, and air intake manifold 430.

The pressure and amount of air provided by compressor 414 varies in accordance with a rate of operation of engine 440, volume and pressure of exhaust gasses that cause rotations of turbine 412. A magnitude of the pressure in pipe 416, inter cooler 420, pipe 422, and air intake manifold 430 may vary from less than 0 psi (e.g., vacuum) to 60 pounds-per-square-inch ("psi"). Pump 484 provides fuel (e.g., a reactant) from tank 480 at a pressure via pipes 482 and 486 to a combustion chamber of engine 440. Fuel may be vaporized prior to delivery under pressure to the combustion chamber.

A system may detect a magnitude of the pressure of delivery of a reactant. A system may detect a magnitude of a pressure of a reaction chamber. A system may increase or decrease a magnitude of a pressure of delivery of a catalyst in accordance with the magnitude of the pressure of delivery of a reactant or a magnitude of pressure of a reaction chamber. A system may adjust a magnitude of pressure of delivery of a catalyst to facilitate transport to a reaction chamber or introduction (e.g., injection, insertion, entry) into a reaction chamber. A system may use a pressure of delivery of a reactant to provide a pressure for delivery of the catalyst. A system may use the structure for delivery of a reactant to deliver a catalyst.

A system may use a reactant as a medium to provide the catalyst. A system may introduce (e.g., inject, insert, provide, release, mix) a catalyst into a reactant. A system may combine a catalyst with a reactant. A system may use a reactant and delivery of a reactant to provide a catalyst for a reaction. A system may chemically react a catalyst with one or more reactants prior to delivery to a reaction chamber for catalysis with any remaining reactants. A system may use movement of a reactant toward a reaction chamber to transport (e.g., move, carry) a catalyst toward the reaction chamber. A system may increase a magnitude of a pressure of delivery of a reactant to facilitate delivery of a catalyst via the reactant.

A system may provide (e.g., release, meter) a catalyst in any quantity (e.g., dose, volume, mass). A system may vary an amount of catalyst provided over time. A system may provide an amount of catalyst in accordance with a rate of reaction, a quantity of reactant provided, a pressure of delivery of a catalyst, and a rate of operation (e.g., reaction rate) of a reactant chamber.

A system may detect a rate of reaction, a quantity of reactant provided, a pressure of delivery of a catalyst, or a rate of operation of a reactant chamber directly or indirectly. Rate of reaction, quantity of reactant provided, pressure of delivery of a reactant, and rate of operation of a reaction chamber may vary over time. A system may detect variations and provide catalyst in accordance with a variation. A system may provide a base amount of catalyst and provide incremental additional amounts (e.g., increase, decrease) responsive to variations.

A system may deliver catalyst in accordance with operation of an internal combustion engine.

A catalyst may be provided to a reaction chamber to alter a reaction. A catalyst may be homogenous or heterogeneous with respect to one or more reactants. A reaction may reduce an activation energy of a reaction, accelerate a rate of reaction, reduce a concentration of a reactant, reduce a temperature of a reaction, enhance completion of a reaction, or alter a composition of reaction byproducts.

For example, in an internal combustion engine, a catalyst may be provided to the combustion chamber to reduce production of carbon monoxide, oxides of nitrogen ($NO_x$), hydrocarbons, soot, and smoke, to improve fuel (e.g., hydrocarbons, fuel oils, diesel, gasoline, natural gas, gasohol, any hydrocarbon, any alcohol, any vegetable oil, coal, wood, paper) efficiency, and to reduce deposits inside the engine. A furnace includes a combustion chamber that may benefit from use of a catalyst.

A catalyst may include an element or a compound of elements. For example, with reference to a conventional period table, a catalyst may include an element from group I, II, II, IVA, VI, VII, VIII, perrhenic acid, metaperrhenates, carbonyl, halides, and any combination thereof. A catalyst may further include a sorbent, an antifreeze agent, and a surfactant to enhance delivery and storage of the catalyst. A catalyst may include a chemical for adjusting a pH of the catalyst to reduce agglomeration. A catalyst may be suspended in a solution.

A catalyst may be of the type described in U.S. Pat. No. 6,776,606 to Haskew, U.S. Pat. No. 6,602,067 to Robinson, U.S. Pat. No. 6,419,477 to Robinson, U.S. Pat. No. 6,176,701 to Robinson, U.S. Pat. No. 5,085,841 to Robinson, U.S. Pat. No. 4,475,483 to Robinson, and U.S. Pat. No. 4,295,816 to Robinson, each patent is herein incorporated by reference.

Figure 4:
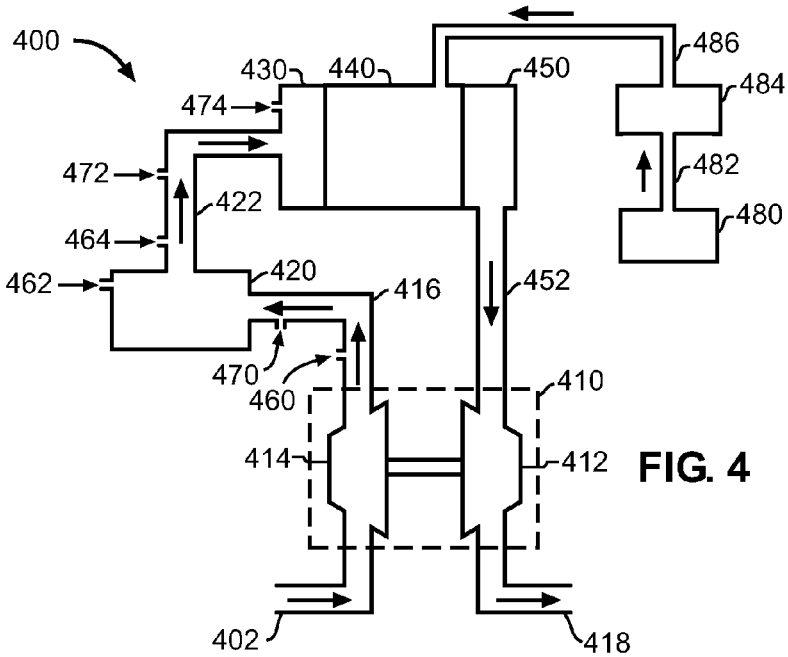
FIG. 4 is a functional block diagram of a power plant having inlet and outlet locations for the systems of FIGS. 1-3.
Figure 2:
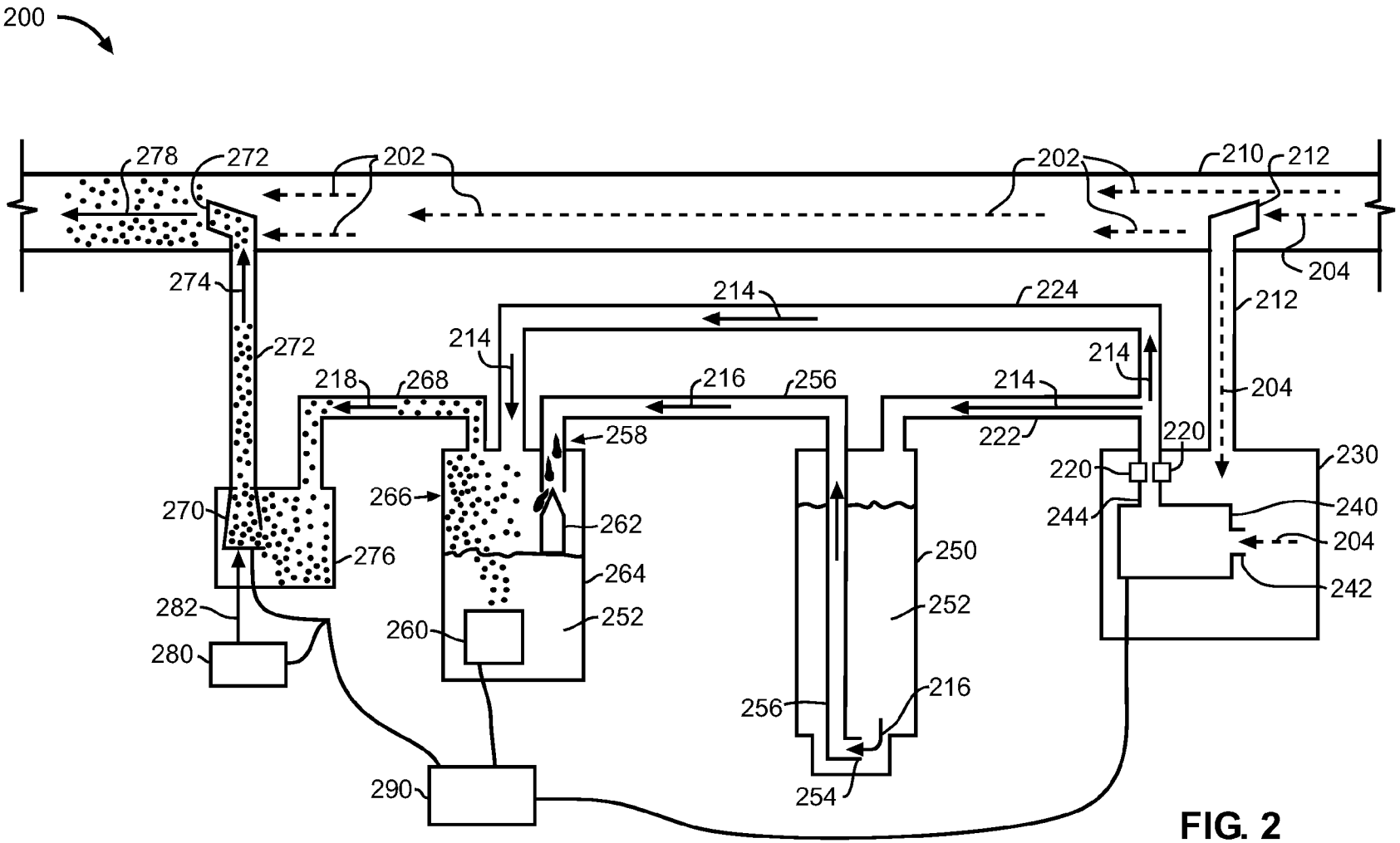
FIG. 2 is plan view of an implementation of the system of FIG. 1.
Figure 3:
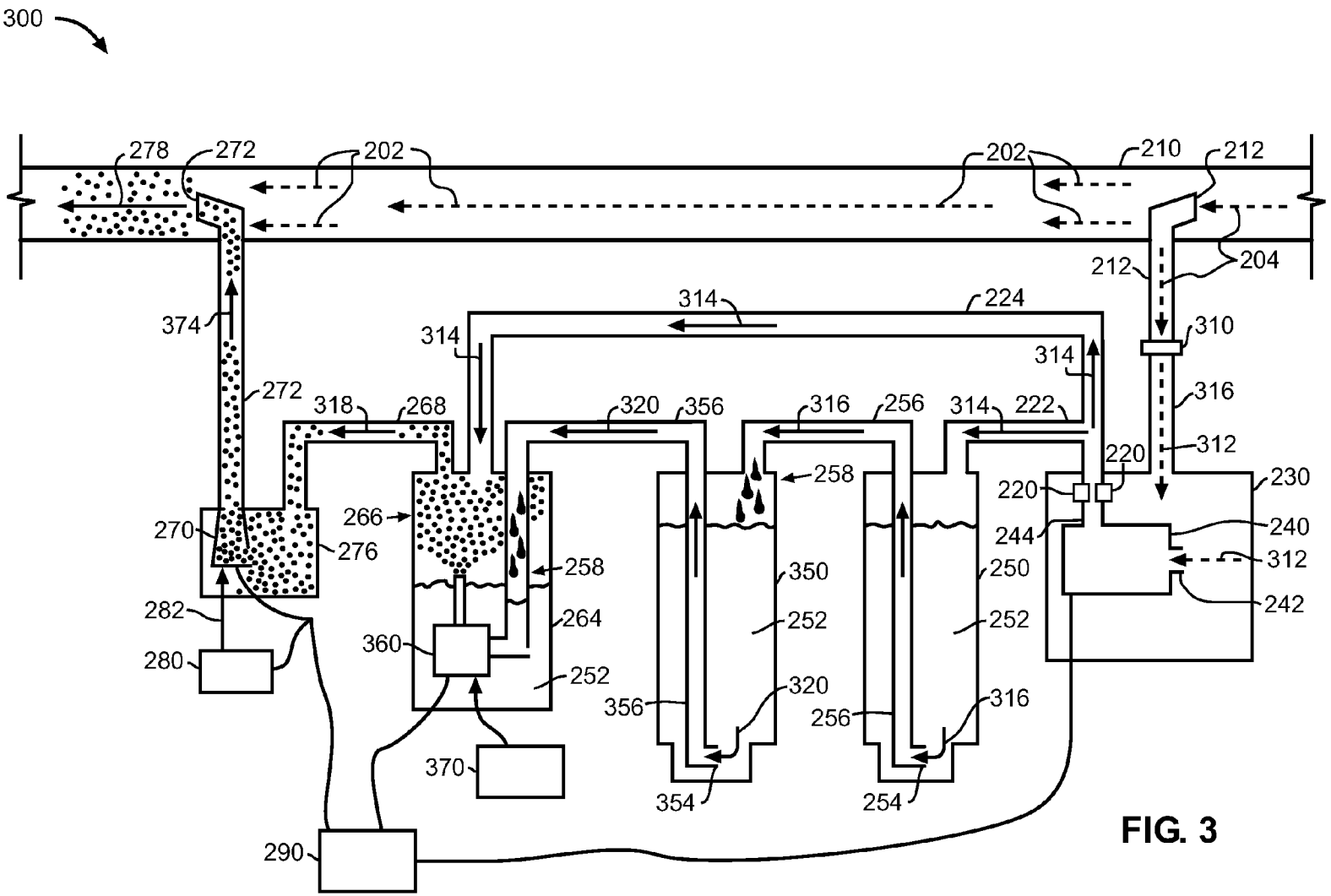
FIG. 3 is plan view of another implementation of the system of FIG. 1.
Figure 5:
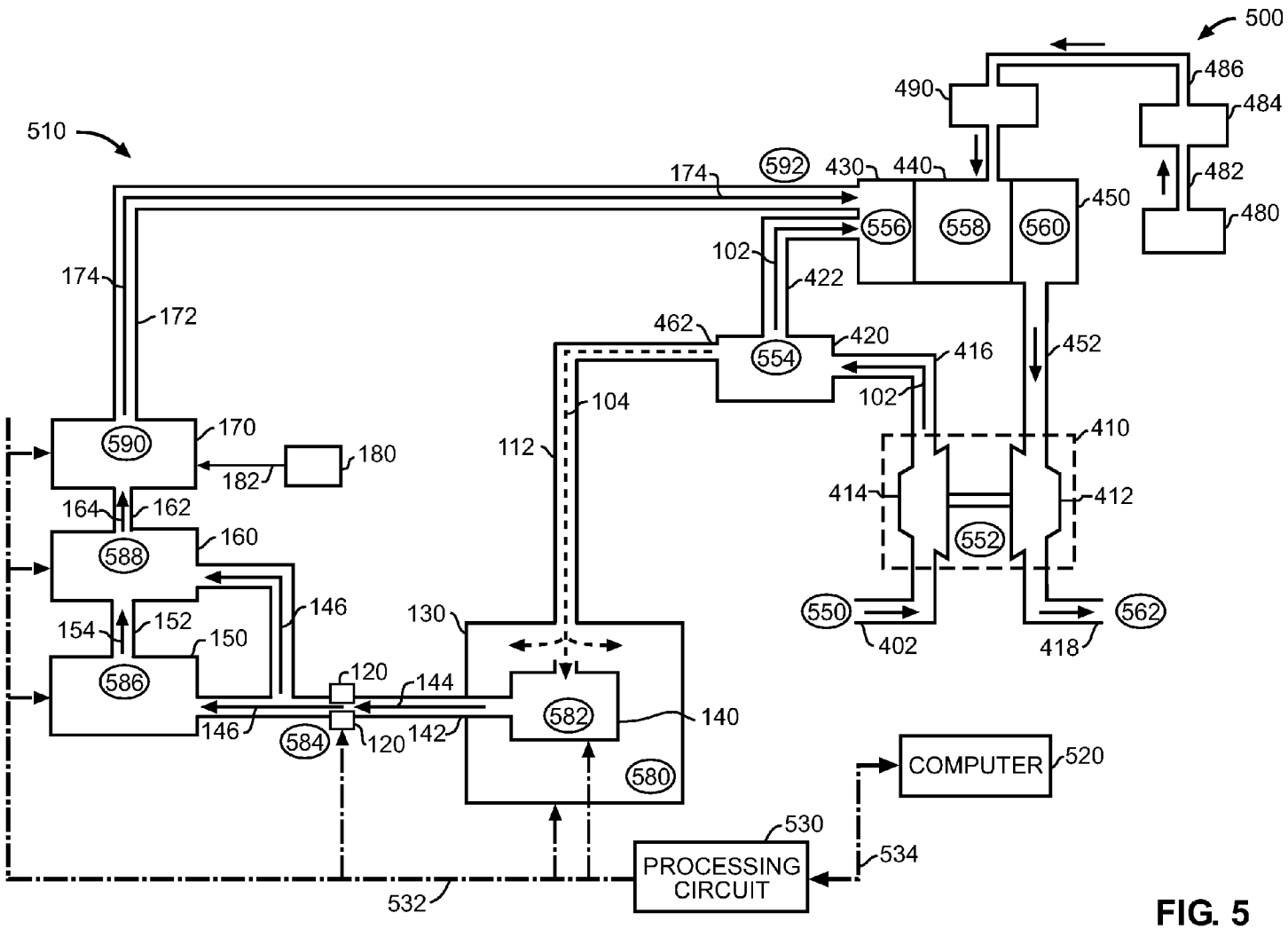
FIG. 5 is a functional block diagram of a power plant and the system of FIG. 1.
Figure 6:
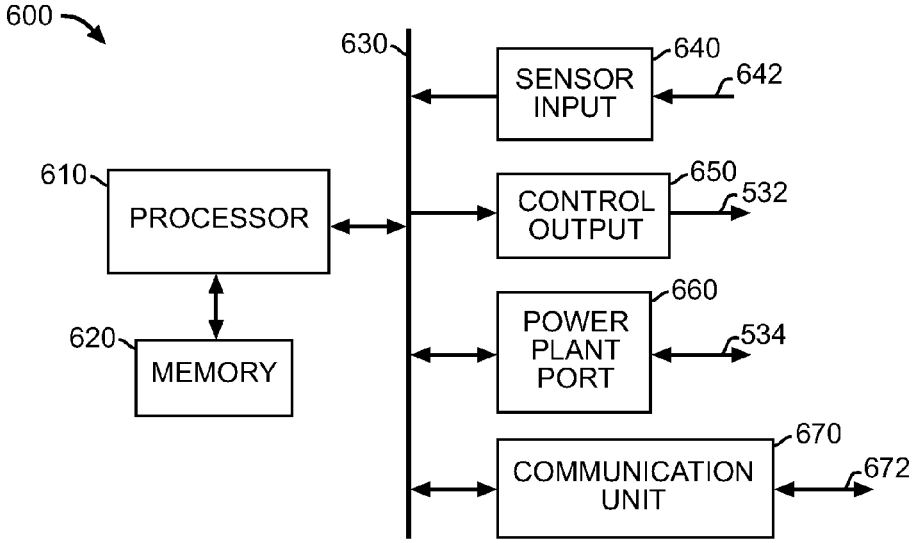
FIG. 6 is a functional block diagram of a processing circuit of the system of FIGS. 1-3.
Figure 7:
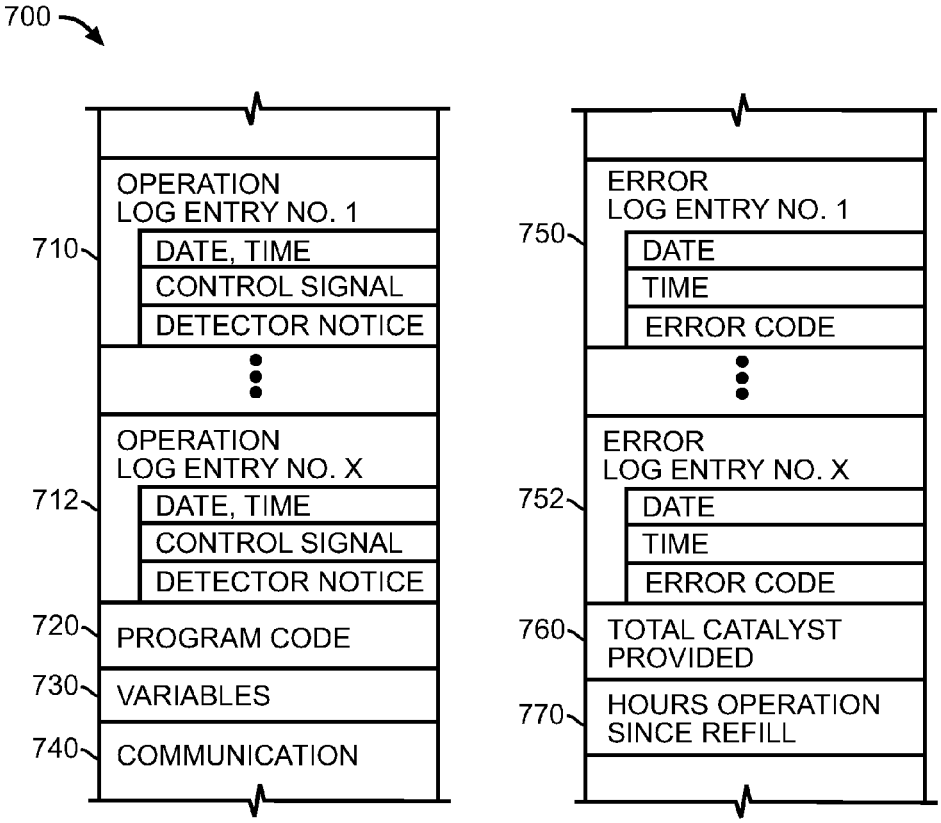
FIG. 7 is a memory map of a memory of processing circuit of FIG. 6.

For example, systems 100, 200, and 300 of FIGS. 1-7, according to various aspects of the present invention, provide a catalyst. The systems use a reactant (e.g., air) as a medium of delivery of the catalyst to a reaction chamber. The systems use movement of the reactant to transport the catalyst to the reaction chamber. The systems use a pressure of delivery of the reactant to provide the catalyst at a pressure greater than the pressure of delivery of the reactant. The systems meter delivery of the catalyst to the medium of delivery thereby metering provision of the catalyst to the reaction chamber. The systems may meter delivery of the catalyst in accordance with operation of the reaction chamber.

System 100 includes inlet 112, enclosure 130, pump 140, restrictor 120, container 150, atomizer 160, metering device 170, detector 180, and outlet 172.

An enclosure receives a portion of a flow of a reactant. A portion of a flow of reactant is provided at about the same pressure as the flow of reactant. An enclosure pressurizes to a pressure of the portion of the flow of the reactant. A pressure of an enclosure varies with the pressure of the portion of the flow of the reactant. The pressure of the portion varies with the pressure of the flow of the reactant. An enclosure contains the portion of the flow of reactant.

An enclosure encloses a pump. A pump includes an inlet and an outlet. An enclosure provides a reactant to the inlet of a pump. An outlet of the pump exits the enclosure. An enclosure provides an environment for providing prime to a pump. No part of the portion of the flow of the reactant exits (e.g., leaves) the enclosure except through (e.g., via) the outlet of the pump.

A pump receives a reactant at an inlet of the pump at a pressure. A pump provides a reactant at an outlet of the pump at a pressure. A pump provides a reactant at the outlet of the pump at a pressure greater than the pressure of the reactant at the inlet or the pressure of the reactant in the enclosure.

A pump is sealed in the enclosure in such a manner that any reactant that leaves the outlet of the pump comes from the enclosure via the inlet of the pump. A pressure at an outlet of the pump varies with respect to the pressure at the inlet of the pump. The pressure at the inlet of the pump varies with the pressure of the portion of the flow of reactant received by the enclosure. The pressure of the portion of the flow varies with the pressure of the flow of reactant. A pressure of a flow of reactant may vary in accordance with a rate of operation of a reaction chamber as described above.

A pump provides the reactant at the outlet of the pump in such a manner that regardless of the pressure of the reactant at the inlet of the pump, the pump provides the reactant at the outlet at the pressure of the reactant at the inlet plus an increased pressure provided by the pump. In the event that the pressure of the reactant to the inlet of the pump drops below zero (e.g., vacuum) less than the magnitude of the increased pressure provided by the pump, the pump provides the reactant at the outlet of the pump at a pressure greater than zero.

A pump includes any conventional pump suitable for receiving a reactant and providing a flow of reactant at a pressure. A pump may include a diaphragm pump.

A restrictor restricts (e.g., reduce, limit, check, restrain, hold within bounds) a flow of reactant. A restrictor may restrict a flow of gas. A restrictor may receive a flow of reactant. An inlet of a restrictor receives a flow at a pressure. An outlet of a restrictor provides at least a portion of the flow received at the inlet of the restrictor. An outlet of a restrictor may provide a flow at a same, a reduced, or an increased pressure as the inlet of the restrictor. A restrictor may limit a flow to a fixed amount for a pressure. A restrictor may vary a flow from an outlet of the restrictor. A restrictor may vary a flow in accordance with an amount of catalyst required for a reaction.

A sudden (e.g. rapid, precipitous) decrease in a magnitude of a pressure of a flow at an inlet of a restrictor may permit a flow of reactant to enter the outlet and exit the inlet. In such a situation, a flow may continue from outlet to inlet until a magnitude of the pressure of any accumulated reactant on the outlet side of the restrictor has been reduced to a present pressure of the inlet of the restrictor. Thereafter, a flow of reactant may be reestablished from inlet to outlet.

A restrictor includes any conventional structure for restricting a flow of a reactant. A restrictor includes a structure having an orifice therethrough. A restrictor may include a conduit having a reduced inside diameter for at least a portion of the conduit. An orifice or an inside diameter of a restrictor may be proportional to a target rate of delivery of a catalyst by the system.

A container (e.g., bottle, receptacle) contains a catalyst. A catalyst may be of the type described above. A catalyst may be a salute of solution (e.g., liquid, gas). A catalyst may be suspended in a solution. The solution may be contained in the container. An inlet of a container may receive a flow of a reactant at a pressure. Responsive to the pressure at the inlet, a container may provide the catalyst or the solution bearing the catalyst at an outlet of the container. A reactant may enter an inlet of a container and exit an outlet of the container. An exiting reactant may transport the catalyst out of the container. A container may be replaced or refilled with a catalyst or a solution bearing a catalyst prior to or upon exhaustion of the catalyst in the container. A container may provide a notice of a fullness of the container or a remaining amount of the catalyst. A notice may include a visual, audible, or electronic indicator.

A container includes any conventional container for containing a solution bearing a catalyst. Preferably, the container does not react with, consume, or limit provision of the catalyst.

An atomizer receives a solution (e.g. liquid). An atomizer provides a vapor. An atomizer may receive a solution bearing a catalyst and provide a vapor bearing the catalyst. An atomizer may receive a flow of a reactant. An atomizer may burden (e.g., load) the flow of the reactant with the vapor bearing the catalyst, thus an atomizer may introduce the catalyst into the flow of the reactant. Accordingly, an atomizer may use a flow of a reactant to transport a catalyst out an outlet of the atomizer. An atomizer may provide a flow of a reactant bearing a catalyst.

An atomizer includes any conventional atomizer for atomizing a solution. An atomizer includes a piezoelectric, mechanical, air assist, and ultrasonic atomizer.

An atomizer may be of the type described in U.S. Pat. No. 7,481,379 to Cunningham, U.S. Pat. No. 6,786,714 to Haskew, U.S. Pat. No. 6,776,606 to Haskew, U.S. Pat. No. 4,475,483 to Robinson, U.S. Pat. No. 4,295,816 to Robinson, and U.S. patent publication no. 2006/0112906 to Cunningham, each patent or patent publication is herein incorporated by reference.

A metering device may receive a catalyst, a flow of reactant, or a flow of reactant bearing a catalyst. A metering device may provide a measured amount of catalyst, reactant, or reactant bearing catalyst. A metering device may provide a measure amount of catalyst via the measured flow of reactant. A metering device may provide (e.g., release) a flow of reactant bearing a catalyst into another flow of reactant. A metering device may release a flow of reactant bearing a catalyst at a pressure greater than the pressure of the other flow of reactant. A pressure of a flow of reactant provided by a metering device may vary in accordance with the pressure of the other flow of reactant. A metering device may provide an amount of catalyst proportional to a rate of reaction. A metering device may provide an amount of catalyst proportional to a rate of operation of a reaction chamber.

A metering device includes any conventional metering device. A metering device includes a metering pump, an oscillating valve, and an injector.

A detector (e.g., sensor) may detect a magnitude of a pressure, a rate of reaction, a rate of providing a reactant, an effect of a catalyst on a reaction, a chemical composition of a byproduct of a reaction (e.g., exhaust gas), a presence of an element or compound after a reaction, a quantity of an element or compound after a reaction, a temperature, and a quantity of a reactant. A detector may detect a physical quantity, a physical property, or an occurrence of an event. An event may include a change in a physical quantity or a physical property greater than a threshold. For example, an event may include a change in a magnitude of a pressure of a reactant and a rate of change of a magnitude of a pressure of a reactant.

A detector may detect directly (e.g., observation, sensing, measurement, sampling) or indirectly. For example, a detector may detect a magnitude of a pressure in a pipe that delivers a reactant, a volume of a reactant provided, a revolutions-per-minute ("rpm") of a compressor that provides a reactant, a chemical composition of an exhaust gas, a position of a throttle, movement of a throttle, or an acceleration of movement of a throttle.

A detector may provide a notice in accordance with detecting. A notice may include an electrical signal. A detector may include a processing circuit that performs a calculation. A calculation may include using a detected physical quantity, physical property, or occurrence of an event to determine a flow of reactant or a rate of reaction. A detector may perform a self diagnostic test and provide a notice in accordance with the test.

A detector includes any conventional detector. A detector includes optical, mechanical, electrical, electrical property, magnetic, and semiconductor detectors.

A metering device may release a catalyst in accordance with a notice from a detector. A metering device may provide a quantity of a catalyst or a reactant bearing a catalyst in accordance with a notice from a detector. A metering device may increase or decrease a quantity of catalyst or reactant bearing catalyst in accordance with a notice from a detector.

In one implementation, a flow of reactant 102 travels through pipe 110 at a first pressure. The flow of reactant 102 travels toward a reaction chamber (e.g., to right of page) that is not shown. Inlet 112 of system 100 receives a portion 104 of flow of reactant 102. Inlet 112 receives portion 104 at about the same pressure as the flow of reactant 102. The pressure of the flow of reactant 102 is herein referred to as an operating pressure. The operating pressure of flow 102 may vary. As a result, the pressure of portion 104 may also vary.

Portion 104 enters enclosure 130. Enclosure 130 attains the pressure of portion 104, thus the pressure in enclosure 130 is about the same as the pressure of flow of reactant 102. The magnitude of the pressure in enclosure 130 varies in accordance with the operating pressure of flow of reactant 102.

Although enclosure 130 includes inlet 112, enclosure 130 does not have an outlet except through outlet 142 of pump 140. Any reactant from portion 104 that leaves enclosure 130 enters an inlet of pump 140, passes through pump 140, and exits outlet 142 of pump 140. While pump 140 is not operating, portion 104 flows through pump 140 and through all components of system 100 thereby establishing a pressure throughout system 100 that is about the same as the operating pressure. The operating pressure represents, over time, a base pressure at which system 100 operates.

In the event of a sudden drop in operating pressure, reactant may exit enclosure 130 and other portions of system 100 via inlet 112 until the pressure in enclosure 130 or system 100 reaches the present operating pressure. Restrictor, as discussed above, may extend the amount of time it takes the pressure through out system 100 to attain the present operation pressure after a sudden decrease in the operating pressure.

Pump 140 is positioned in enclosure 130. An inlet of pump 140 is positioned inside enclosure 130. Any reactant that enters the inlet of pump 140 comes from enclosure 130. Outlet 142 of pump 140 exits enclosure 130. Pump 140 is sealed in enclosure 130 in such a manner that any reactant that leaves enclosure 130, except in the case of a sudden drop of operating pressure as described above, enters the inlet of pump 140 and exits outlet 142 of pump 140. Positioning pump 140 in enclosure 130 and sealing pump 140 in enclosure as described provides an environment in which pump 140 may achieve and maintain prime regardless of the variations in the operating pressure.

Pump 140 receives portion 104 at the inlet of pump 140 and provides reactant of portion 104 at outlet 142 as flow of reactant 144. A magnitude of the pressure of flow 144 is greater than the magnitude of the operating pressure. The magnitude of the pressure of flow 144 varies in accordance with the operating pressure. In one implementation, the magnitude of the pressure of flow 144 is about 3 psi greater than the magnitude of portion 104 and flow 102. Thus, the pressure of flow 144 as provided by pump 140 represents the operating pressure plus an increased pressure provided by the pump. While pump 140 operates and the operating pressure is stable, the pressure of flows 144, 146, 154, 164, and 174 is the operating pressure plus the increased pressure provided by pump 140.

Another way of describing the pressure in system 100 is to consider the operating pressure as the base pressure that operates throughout the entire system 100 while the increased pressure provided by the pump represents a threshold (e.g., delta) increase in the base pressure. The threshold increase in pressure enables release of catalyst from system 100 back into flow 102 for transport to a reaction chamber.

In the event of a rapid change in the operating pressure, a delay of time may occur before the system reaches a steady-state operation in which the pressure of flows 144, 146, 154, 164, and 174 is the operating pressure plus the increased pressure provided by pump 140.

Restrictor 120 restricts flow of reactant 144. Flow of reactant 144 enters an inlet of restrictor 120. Flow of reactant 146 exits an outlet of restrictor 120. A volume of flow 146 may be proportional to an amount (e.g., maximum, minimum, average) of catalyst to be delivered by system 100. A restrictor provides flow of reactant to container 150 and atomizer 160 via flow of reactant 146. A magnitude of pressure of flow 146 may be greater than or about equal to a magnitude of pressure of flow 144. Flow 146 to atomizer 160 may be omitted in an implementation in which container 150 provides a flow of reactant, in addition to catalyst, sufficient for proper operation of atomizer 160.

In the event of a sudden decrease of operating pressure of flow 102 with the resulting decrease of pressure in enclosure 130, across pump 140, and in outlet 142, a magnitude of pressure of flow 146 along with any accumulated reactant in system 100 may be greater than the present magnitude of the operating pressure. In such a condition, reactant enters the outlet of restrictor 120 and exits the inlet of restrictor 120 until a magnitude of pressure on each side of the restrictor equalizes. A delay of time required for the pressure at the outlet of restrictor 120 to achieve equality with the pressure of the inlet of restrictor 120 may vary inversely proportionally with a size of an orifice through restrictor 120. The operating pressure of flow 102 may return to a higher pressure prior to equalization across restrictor 120, thus accumulated reactant in system 100 may not be significantly depleted or a magnitude of pressure past restrictor 120 significantly decreased.

Container 150 contains a solution bearing a catalyst. The catalyst may be of the type described above. An inlet of container 150 receives the pressure of flow of reactant 146. Responsive to the pressure of flow 146, outlet 152 of container 150 provides flow of solution 154 that includes the catalyst. A container may further provide a flow of reactant along with flow of solution 154. In an embodiment that provides only solution via outlet 152, flow of reactant 146 to atomizer 160 provides a flow of reactant to atomizer 160 to transport a vapor provided by atomizer 160.

Container 150 may include a detector that provides a notice of a fullness of container 150. A notice may be audible, visual, or electronic. A notice may notify a user when container 150 needs additional solution or when the catalyst has been depleted from the solution.

Atomizer 160 receives flow of solution 154 and a flow of reactant whether with flow of solution 154 via outlet 152 or from flow of reactant 146. Atomizer atomizes (e.g., nebulizes, vaporizes) flow of solution 154 to provide a vapor bearing the catalyst. Atomizer 160 mixes the vapor bearing the catalyst with the flow of reactant to provide flow of reactant bearing catalyst 164 from outlet 162. A rate of operation of atomizer 160 may be adjusted to provide a minimum amount of vapor bearing the catalyst. The rate of operation of atomizer 160 may increase or decrease to provide more or less vapor containing catalyst. A rate of vaporization of atomizer 160 may increase or decrease in accordance with a detector. A rate of atomization may be proportional to a volume of portion 104 with respect to the volume of flow 102, thus an amount of catalyst carried by portion 104 may represent a higher concentration than required for a reaction that uses only portion 104 as a reactant, but represents a proper concentration of catalyst for a reaction that uses the larger flow of reactant 102 as the reactant.

Metering device 170 receives flow of reactant bearing catalyst 164. Metering device 170 provides an amount of reactant bearing catalyst to outlet 172 of system 100. Flow of reactant bearing catalyst 174 is the amount of reactant and catalyst provided by metering device 170.

Detector 180 detects a physical quantity, a physical property, or occurrence of an event and provides electrical signal 182 to metering device 170. Signal 182 may convey information using any electrical property including voltage, current, or charge. Signal 182 may be digital or analog. Signal 182 may be encoded. Metering device 170 may include an electronic or processing circuit to receive signal 182. An electronic or processing circuit may receive signal 182 and change an amount of flow 174 provided by metering device 170.

In one implementation, detector 180 detects a position of a throttle and provides a signal in accordance with position. Throttle position provides an indication of an amount of reactant being transported or to be transported to an engine for combustion. A catalyst may be provided by system 100 in an amount proportional to the position of the throttle. In an implementation, detector 180 includes a potentiometer that detects a position of the throttle.

In another implementation, detector 180 detects the rpm of compressor 414 of turbocharger 410. The rpm of turbocharger 410 provide an indication of an amount of reactant (e.g., air) being delivered to a combustion chamber of an engine. A catalyst may be provided by system 100 in an amount proportional to the present rpm of compressor 414.

In another implementation, detector 180 detects a chemical composition of exhaust gases provided by engine 440. In accordance with the chemical composition of the exhaust gases, metering device 170 may increase or decrease an amount of catalyst provided to the combustion chamber of engine 440 until the chemical composition of the exhaust gases reaches a target chemical composition.

Metering device 170 may provide flow 174 in accordance with a detector as described above. Atomizer 160 may provide an amount of vapor and flow 164 in accordance with a detector. Restrictor 120 may restrict flow 146 in accordance with a detector. Container 150 may provide flow of solution bearing catalyst 154 in accordance with a detector. Pump 170 may provide more or less increased pressure in accordance with a detector.

Outlet 172 of system 100 couples to pipe 110. Because metering device 170 provides flow 174 to outlet 172 at the operating pressure plus the increased pressure provided by pump 140 (e.g., base pressure plus delta pressure), flow 174 enters pipe 110 and mixes, at least partially, with flow 102 to form flow 106. The increased pressure provided by pump 140 on top of the operating pressure of flow 102 forces flow 174 out of outlet 172 and into flow 102. Lacking the increased pressure from pump 140, flow 174 would not exit system 100 or enter flow 102. The increased pressure provided by pump 140 is sufficient to move flow 174 out of system 100 and into pipe 110. A magnitude of the pressure of flow 106 may be greater than the magnitude of the pressure of flow 202.

In one implementation, the operating pressure of flow of reactant 102 ranges between slightly below 0 psi (e.g., slight vacuum) and 60 psi, but operates nominally at 15 psi. The increased pressure provided by pump 140 is 3 psi. Thus, the pressure of flow 174 is 18 psi as opposed to the 15 psi of flow of reactant 102 in pipe 110. The increased pressure of 3 psi moves flows 144, 146, 154, 164, and 174 through and out system 100 and into pipe 110. Thus, portion 104 of flow 102 is separated from flow 102, its pressure is increased, it is burdened with a catalyst, and reintroduced into flow 102 for transport to a reaction chamber. Accordingly, flow of reactant 102 acts as a medium of transport to transport a catalyst to a reaction chamber.

System 200 includes inlet 212, enclosure 230, pump 240, restrictor 220, container 250, atomizer 260, float valve 262, container 264, metering device 270, container 276, detector 280, power supply 290, and outlet 272.

The functions performed by inlet 212, enclosure 230, pump 240, restrictor 220, container 250, atomizer 260, metering device 270, detector 280, and outlet 274 are similar to the functions described above for inlet 112, enclosure 130, pump 140, restrictor 120, container 150, atomizer 160, metering device 170, detector 180, and outlet 174 respectively.

Pipe 210 transports flow of reactant 202 at an operating pressure to a reaction chamber. Inlet 212 receives a portion 204 of flow of reactant 202 at the operating pressure. Portion 204 enters enclosure 230 and pressurizes enclosure 230 and pump 240 to the operating pressure. Portion 204 does not exit enclosure 230 except via outlet 244 of pump 240, except in the case of a sudden drop in operating pressure as described above.

Inlet 242 of pump 240 receives reactant from portion 204 in enclosure 230. Pump 240 provides a flow of reactant from enclosure 230 out outlet 244. The flow of reactant from pump 240 passes through restrictor 220 to provide flow of reactant 214. A magnitude of the pressure of flow of reactant 214 is the operating pressure of flow 202 plus an increased pressure provided by pump 240 as described above. Flow of reactant 214 is transported by conduits 222 and 224 to containers 250 and 264 respectively.

Container 250 contains solution bearing a catalyst (e.g., catalytic solution) 252. Pressure from flow of reactant 214 presses on catalytic solution 252 forcing catalytic solution 252 into inlet 254 of conduit 256. Flow of solution 216 traverses conduit 256 and enters container 264 as represented by droplets 258. Flow of reactant 214 also traverses conduit 224 to enter container 264. Because inlet 254 of conduit 256 is positioned at a lower portion of container 250, flow of reactant 214 cannot enter conduit 256, thus conduit 256 delivers flow of solution 216 absent any flow of reactant.

Float valve 262 controls a flow of catalytic solution 252 into container 264. When the reservoir of catalytic solution 252 in container 264 reaches a threshold, float valve 262 stops the flow of catalytic solution 252 from container 250 into container 264. When the reservoir of catalytic solution 252 in container 264 decreases below a threshold, float valve 262 opens to admit more catalytic solution 252.

Piezoelectric atomizer 260 is position in the reservoir of catalytic solution 252 in container 264. Piezoelectric atomizer 260 atomizes catalytic solution 252 to provide vapor 266 that contains catalyst. Flow of reactant 214 mixes with vapor 266 to form flow of reactant bearing catalyst 218. The pressure of flow of reactant 214 moves vapor 266 out of container 264 via conduit 268 to container 276.

Container 276 contains flow of reactant bearing catalyst 218 for metering by metering device 270. Metering device 270 provides flow of reactant bearing catalyst 274 at the operating pressure plus the increased pressure provided by pump 240. Flow of reactant bearing catalyst 274 exits outlet 272 to mix with flow 202. The operating pressure plus the increased pressure provided by pump 240 moves flows 204, 214, 216, 218, and 274 through and out system 200 back into pipe 210.

Metering device 270 provides flow of reactant bearing catalyst 274 in accordance with detector 280 as described above.

Outlet 272 of system 100 couples to pipe 210. Because system 200 provides flow 274 at outlet 272 at the operating pressure plus the increased pressure provided by pump 240 (e.g., base pressure plus delta pressure), flow 274 is forced into pipe 210 and mixes, at least partially with flow 202 to form flow 278. A magnitude of the pressure of flow 278 may be greater than the magnitude of the pressure of flow 202. The increased pressure provided by pump 240 in addition to the operating pressure of portion 204 forces flow 274 out of outlet 272 and into flow 202. Lacking the increased pressure from pump 240, flow 274 would not exit system 200 or enter flow 202. The increased pressure provided by pump 240 is sufficient to move flow 274 out of system 200 and into pipe 210.

Power supply 290 provides electrical power to pump 240, piezoelectric atomizer 260, detector 280, and metering device 270 for operation of each respective component.

System 300 includes inlet 212, one-way valve 310, enclosure 230, pump 240, restrictor 220, container 250, container 350, container 264, atomizer 360, fluid supply 370, metering device 270, container 276, detector 280, power supply 290, and outlet 272.

The components of system 300 having the same indicator number as a component of system 200 function in the manner described above.

One-way valve 310 is positioned between inlet 212 and enclosure 230. Portion 204 of flow of reactant 202 enters inlet 212 at the operating pressure, passes through one-way valve 310 as portion 312 of flow of reactant 202. Portion 312 pressurizes enclosure 230.

In the event that the operating pressure of flow of reactant 202 suddenly drops, one-way valve 310 closes thereby stopping a flow of reactant from enclosure 230 via conduits 316 and 212 back into pipe 210. While one-way valve 310 is closed, pump 240 continues to pump the accumulated reactant from enclosure 230. If a magnitude of the operating pressure of flow of reactant 202 rises above the magnitude of the pressure of reactant in enclosure 230, one-way valve 310 opens to provide additional reactant via portions 212 and 312 of flow of reactant 202. If the operating pressure of reactant 202 remains at a reduced magnitude, pump 240 continues to pump until a magnitude of the pressure in enclosure 230 decreases until it is less than the present magnitude of the operating pressure of flow of reactant 202 thereby opening one-way valve 310 to admit additional reactant into enclosure 230 via flows 212 and 312.

As set forth above, restrictor 220 further acts to maintain an increased pressure in a portion of system 300 when the operating pressure of flow of reactant 202 suddenly drops.

System 300 further includes container 350. Like container 250, container 350 contains catalytic solution 252 and provides flow of solution bearing catalyst 320 responsive to the pressure applied by flow of solution 316. Container 350 is coupled in series with container 250, thus flow of solution 316 that exits container 250 enters container 350. Flow of solution 320 exits container 350 via conduit 356 and enters container 264 for atomization. Because inlet 354 of conduit 356 is positioned near a bottom of container 350, container 350, like container 250, provides catalytic solution 252 without a flow of reactant. Once the solution has been pushed from container 250 to container 350, conduit 256 may provide a flow of reactant to container 350.

Coupling container 350 in series with container 250 extends an amount of time containers 350 and 250 may provide catalytic solution 252 as opposed to single container 250. Any number of containers of catalytic solution 252 may be coupled in series to length a time of delivery of catalytic solution 252. In a situation where additional solution may be required, containers may be coupled in parallel to provide an increased flow of catalytic solution 252.

Mechanical atomizer 360 atomizes catalytic solution 252 to provide vapor 266 that contains catalyst. Flow of solution 320 enters container 264. Mechanical atomizer 360 receives catalytic solution 252 from the reservoir of catalytic solution 252 in container 264. Flow of reactant 314 mixes with vapor 266 to form flow of reactant bearing catalyst 318. The pressure of flow of reactant 314 moves vapor 266 out of container 264 via conduit 268 to container 276. Fluid supply 370 provides a fluid (e.g. compressed air) to mechanical atomizer 360 to accomplish atomization.

A mechanical atomizer includes conventional atomizers, ultrasonic atomizers, and air assisted atomizers. A mechanical atomizer may be of any of the type described in non-patent literature document entitled "Air Assisted Atomizers," CTG AZ15 BR, herein incorporated by reference, published by PNR UK LTD, 16, Sugarbrook Road, Aston Fields Ind. Estate, Bromsgrove, Worchester, B60 3DW and available at www.prn-nozzles.com.

In system 300, metering device 270 provides flow of reactant bearing catalyst 374. As described above, flow of reactant bearing catalyst 374 exits outlet 272 to mix with flow 202. The operating pressure plus the increased pressure provided by pump 240 moves flows 204, 312, 314, 316, 318, 320, and 374 through and out system 300 back into pipe 210.

An inlet and an outlet of a system may couple to a structure that provides a flow of reactant to a reaction chamber. An inlet receives a portion of the flow of the reactant and provides the portion of the flow of reactant bearing a catalyst out the outlet of the system and back into the flow of reactant for transport to the reaction chamber.

In one implementation, inlet 112 (212) and outlet 172 (272) may couple at any location along structure (e.g., pipe 416, intercooler 420, pipe 422, and air intake manifold 430) between compressor 414 of turbocharger 410 and air intake manifold 430 of engine 440. Inlet 112 couples to a position of the structure that is farther, with respect to a direction of the flow of air, from compressor 414 than outlet 172. In one implementation, inlet 112 couples at location 460 while outlet 172 couples at location 470, 472, or 474. In another implementation, inlet 112 couples at location 462 while outlet 172 couples at location 472 or 474. In another implementation, inlet 112 couples at location 464 while outlet 172 couples at location 472 or 474. Preferably, inlet 112 couples to a ¼ inch NTP fitting located in most turbocharged systems near the outlet of intercooler 420 and outlet 172 couples to a ¼ inch NTP fitting located on air intake manifolds of most engines.

In one implementation, system 100, 200, or 300 receives a portion of the air provided by compressor 414 of turbocharger 410 at the operating pressure of the air, increases the pressure of the portion of air received, burdens the air with a catalyst, and releases the air bearing the catalyst back into the flow of air provided by compressor 414.

An inlet may be shaped (e.g., angled, curved) and positioned into (e.g., facing) a flow of reactant to better receive a portion of the flow of reactant. An outlet may be shaped and positioned with (e.g., same direction as) a flow of reactant to better provide a reactant bearing a catalyst to the flow of reactant.

Systems 100, 200, and 300 may include a mounting structure (not shown). A mounting structure facilitates positioning and coupling components (e.g., enclosure, container, power supply, detector, conduit, one-way valve) with respect to each other. A mounting structure facilities mounting a system to a power plant. A component of a system may mount to a mounting structure using a quick release device. For example, container 150, 250 or 350 may use a quick release device to couple to a mounting structure and the conduits coupled to the containers to facilitate quick removal and replacement of the containers upon exhaustion of the solution or catalyst in the solution. A quick release device includes any conventional quick release coupler, for example, a bayonet mount, a clamp, a cam, a threaded coupling, and a clip.

A system for providing a catalyst may include a plurality of detectors. Each detector may detect an aspect of the operation of the system. Each detector of the system may provide a notice. A notice may include information about a physical quantity, a physical property, or an occurrence of an event detected by the detector. A system may provide a catalyst in accordance with one or more notices from one or more detectors.

A system may include a processing circuit. A processing circuit may receive a notice. A processing circuit may provide a control signal in accordance with a notice. A processing circuit may provide a control signal in accordance with a formula. A formula may be stored in a memory.

A control signal may control an aspect of the operation of the system. A control signal includes any type of signal including electrical, optical, mechanical, and electro-magnetic signal. A processing circuit may convert a control signal of one type into a control signal of another type. For example, a processing circuit may convert an electric impulse into mechanical movement (e.g., a solenoid).

A power plant may include detectors. Each detector detects an aspect of the operation of the power plant. Each detector of the power plant may provide a notice. A power plant may provide reactants in accordance with one or more notices from one or more detectors.

A power plant may include a computer. A computer receives notices from detectors. A computer may provide a control signal in accordance with a notice. A control signal may control an aspect of operation of the power plant. A computer may execute a program stored in memory. A computer may perform calculations, store information, recall information, and provide a report. A computer may include a processor, memory, and input/output ports. A computer includes any conventional computer or control board use to control an internal combustion engine regardless of fuel combusted.

A processing circuit of a system may communicate (e.g., send, receive) with a computer of a power plant. A computer may provide notices received by the computer to the processing circuit. A processing circuit may provide notices received by the processing circuit to the computer. A system may provide catalyst in accordance with notices received from the computer of the power plant. A system may provide catalyst in accordance with notices received from the computer of a power plant to the exclusion of notices received by detectors of the system that provides a catalyst.

A processing circuit may receive notices directly from detectors of the power plant. Detectors of the system may provide notices directly to a computer of a power plant. Functions of a processing circuit may be performed by a computer of a power plant.

For example, system 510 provides a catalyst to power plant 500. Power plant 500 includes components having the same number indicators as described above. Power plant 500 further includes fuel injector 490, computer 520, and detectors 550-562. No connections between computer 520 and detectors 550-562 are shown; however, each detector 550-562 communicates with computer 520 to send notices to computer 520. No control signals from computer 520 and any other component of power plant 500 are shown; however, computer 520 provides control signals to components of power plant 500 to control operation of the components and the overall operation of power plant 500.

Computer 520 may further receive notices from a detector operated by a human operator (e.g., throttle). Human operated detectors are not shown, but such detectors may be a factor in controlling operation of power plant 500.

System 510 includes components having the same numerical indicators as described above. System 510 further includes processing circuit 530, control bus 532, link 534, and detectors 580-592. Connections between processing circuit 530 and detectors 580-592 are not shown; however, each detector 580-592 provides notices to processing circuit 530.

An injector provides a reactant (e.g., fuel) to a reaction chamber (e.g., combustion chamber). An injector may provide a measure amount of reactant. An injector may provide a reactant on a timed basis (e.g., periodic, according to demand, according to movement of a piston). An injector may provide a reactant proportional to another reactant (e.g., air) delivered or to be delivered to a reaction chamber.

A control bus communicates control signals from a processing circuit to a component. A control bus includes a medium (e.g., electrical conductor, electromagnetic wave, optical fiber) for sending control signals from a processing circuit to a component. In one implementation, control bus 532 includes two or more electrical conductors for communicating electrical control signals from processing circuit 530 to components of system 510. A control bus may include any conventional electronic bus standard or protocol. A control bus may be synchronous or asynchronous.

A link provides communication between a computer of a power plant and a processing circuit of a system that provides a catalyst. A link may provide bidirectional communication. A link may provide unidirectional communication from computer to processing circuit or visa versa. A link may communicate any information or notices received by a computer or a processing circuit. A computer or a processing circuit may selectively provide information or notices to each other. A computer or a processing circuit may request to receive a type of information or a notice. A computer or a processing circuit may detect a presence of each other on the link. A link may include any conventional medium or protocol. A link may be wired or wireless.

In an implementation, computer 520 receives notices from detectors and provides control signals to components of power plant 500 to control an operation of power plant 500.

Detectors 550-562 and 580-592 detect a physical quantity, a physical property, or an occurrence of an event in accordance with its position in power plant 500 or system 510. Detectors 550-562 and 580-592 include any conventional detectors that detect a physical quantity, a physical property, or an occurrence described herein. Each detector 550-562 and 580-592 may include one or more sensors that detect a physical quantity, a physical property, or an occurrence of an event. Sensors of a detector may cooperate to detect.

Detectors 550-562 and 580-592 provide a notice of detected information to computer 520 or processing circuit 530. Sensors of a detector may cooperate provide a notice. Detectors 550-562 or 580-592 may cooperate to provide a notice.

Detector 550 may detect temperature, mass (e.g., mass flow sensor, vane meter sensor, hot wire sensor, membrane sensor), turbulence, pressure, volume, movement, and chemical composition (e.g., presence of oxygen) of or occurrence of an event with respect to the atmospheric air that enters inlet 402.

Detector 552 may detect temperature, mass, turbulence, pressure, volume, movement, and chemical composition of or occurrence of an event with respect to the atmospheric air that enters compressor 414, the compressed air that exits compressor 414, the exhaust gas that enters turbine 412, and the exhaust gas that exits turbine 412. Detector 552 may further detect rpm, temperature, vibration, inertia, and torque of or occurrence of an event with respect to compressor 414 and turbine 412.

Detector 554 may detect temperature, mass, turbulence, pressure, volume, movement, and chemical composition of or occurrence of an event with respect to the compressed air provided by compressor 414, the air that leaves intercooler 420 via conduit 422, and portion 104 that exits intercooler 420 via inlet 112.

Detector 556 may detect temperature, mass, turbulence, pressure, volume, movement, and chemical composition of or occurrence of an event with respect to the compressed air provided by intercooler 420, the air provided by system 510 via outlet 172 (272), and the mixture of flows 102 and 174 (274) in air intake manifold 430. Detector 556 may further detect amount, composition, and density of or occurrence of an event with respect to catalyst provided by flow 174 (274) and as mixed in air intake manifold 430. Detector 556 may further detect a pressure and temperature in or occurrence of an event with respect to air intake manifold 430.

Detector 558 may detect temperature, mass, turbulence, pressure, volume, movement, and chemical composition of or occurrence of an event with respect to the air provided by air intake manifold 430 and fuel provided by injector 490. Detector 558 may further detect a pressure and temperature of or occurrence of an event with respect to each combustion chamber of engine 440.

Detector 560 may detect temperature, mass, turbulence, pressure, volume, movement, and chemical composition of or occurrence of an event with respect to the exhaust gas provided by each combustion chamber to exhaust manifold 460 and that exits exhaust manifold 460. Detector 560 may further detect a pressure and temperature in or occurrence of an event with respect to exhaust manifold 460.

Detector 562 may detect temperature, mass, turbulence, pressure, volume, movement, and chemical composition of or occurrence of an event with respect to the exhaust gas provided by turbine 412 of turbocharger 410.

Detector 580 may detect temperature, mass, turbulence, pressure, volume, movement, and chemical composition of or occurrence of an event with respect to air that enters enclosure 130 (230) and that exits enclosure 130 via pump 140.

Detector 582 may detect temperature, mass, turbulence, pressure, volume, movement, and chemical composition of or occurrence of an event with respect to air that enters pump 140 (240) and exits pump 140. Detector 582 may detect loss of prime by pump 140.

Detector 584 may detect temperature, mass, turbulence, pressure, volume, movement, and chemical composition of or occurrence of an event with respect to air at an inlet, within an orifice, or at an outlet of restrictor 120 (220).

Detector 586 may detect temperature, mass, pressure, volume, movement, and chemical composition of or occurrence of an event with respect to air received by container 150 (250, 350). Detector 586 may detect a chemical composition of a solution bearing catalyst contained in container 150. Detector 586 may detect a magnitude of a pressure exerted by flow 146 on a solution contained by container 150. Detector 586 may detect temperature, mass, pressure, volume, movement, and chemical composition of or occurrence of an event with respect to solution that exits container 150. Detector 586 may detect a fullness of solution bearing catalyst in container 150.

Detector 588 may detect temperature, mass, pressure, volume, movement, and chemical composition of or occurrence of an event with respect to air received from container 150 if any, air received from flow 146 direct to atomizer 160 (260, 360), and solution bearing catalyst received from container 150. Detector 588 may detect temperature, mass, pressure, volume, movement, and chemical composition of or occurrence of an event with respect to vapor bearing catalyst provided by atomizer 160. Detector 588 may detect mass, pressure, volume, movement, and chemical composition of or occurrence of an event with respect to vapor bearing catalyst mixed with air that exits vaporizer 160.

Detector 590 may detect temperature, mass, pressure, volume, movement, and chemical composition of or occurrence of an event with respect to air mixed with vapor bearing catalyst received by metering device 170 (270). Detector 590 may detect temperature, mass, pressure, volume, movement, and chemical composition of or occurrence of an event with respect to metered air mixed with vapor bearing catalyst provided by metering device 170. Detector 590 may detect receipt of notice from detector 180.

Detector 592 may detect temperature, mass, pressure, volume, movement, and chemical composition of or occurrence of an event with respect to air mixed with vapor bearing catalyst provided by flow 174 (274) out outlet 172 (272) of system 510 (100, 200, 300).

In an implementation, processing circuit 530 includes processor 610, memory 620, sensor input 640, control output 650, power plant port 660, and communication unit 670.

A power supply (e.g., 290) provides power to operate processing circuit 530, detectors 580-594, and operation of components that receive a control signal. Computer 520, detectors 550-562, and components of power plant 500 may also receive power from a power supply. Power plant 500 and system 510 may share a power supply.

A processing circuit includes any circuit for performing functions in accordance with a stored program. A processing circuit may include a processor and memory or a conventional sequential machine that executes microcode or assembly language instructions from memory. A processing circuit may include one or more microprocessors, microcontrollers, application specific integrated circuits, digital signal processors, programmable gate arrays, or programmable logic devices.

A processor may track time of day and date. A processor may receive a notice from a detector. A processor may perform a function responsive to receiving a notice from a detector. A processor may control or coordinate the performance of a function performed by one or more components. A processor may gather information for a log. A processor may provide information for a log to a memory for storage. A processor may receive stored information from a log stored in memory. A processor may track or calculate statistical information about the operation of a system that provides a catalyst. A processor may provide a report. A report may include information stored in a log. A report may be communicated via a communication unit.

A processor includes any conventional microprocessor, signal processor, programmable array, or support circuits.

A memory receives information (e.g., data), stores information, and provides retrieved information. A memory may organize information. A memory may receive information organized for storage. A memory may store information organized as a log (e.g., operational, error). A log may include one or more entries. A memory may store and provide instructions for execution by a processor. A memory may store variables and temporary data used by a processor. A memory may store communication protocols or other information used to communicate using a communication unit. A memory may store information about the operation of the system. A memory may store and retrieve a notice from a detector.

An entry of an operation log may include a date, a time of day, a status of present control signals, detector notices received, detector notices receive via a sensor input, detector notices receive via a power plant port, communication information, and information receive or sent via a power plant port. An entry of an error log may include a date, a time of day, and an error code.

A memory may include any conventional memory (e.g., ROM, RAM, SRAM, EPROM, Flash, hard disk).

A sensor input receives notices from one or more detectors. A sensor input may convert a notice from one form (e.g., optical, electrical, mechanical, thermal) to another form. A sensor input may convert a notice to a form usable by a processor (e.g., electrical). A sensor input may multiplex one or more detectors on a single medium (e.g., wire, optical fiber, cable) of communication. A sensor input may select one or more detectors over other detectors (e.g., prioritize) to receive notices. A sensor input may provide power to a detector for operation of the detector. A sensor input may provide a notice to a processor.

A control output provides a control signal to one or more components. A control output may provide a control signal responsive to a communication from a processor. A control output may convert a communication from a processor from one form to another form. A control output may provide a control signal in a form usable by a component (e.g., optical, electrical, mechanical, thermal). A control output may multiplex one or more control signals on a single medium (e.g., wire, optical fiber, cable) of communication. A control output may select one or more components over other components to receive control signals. A control output may address a component to select the component. A control output may provide power to a component for operation of the component. A control output may receive a notice directly from a sensor input and provide a control signal in accordance with the notice.

A power plant port provides a communication link between processing circuit 600 and computer 520. A power plant port may use any conventional medium of communication or protocol for communication.

A processor having a conventional input or output port may perform a function of a sensor input or a control output respectively. A processor having an input/output port may perform a function of a power plant port. A processor having a bus interface (e.g., USB) may perform the function of a power plant port.

A communication unit communicates (e.g., transmits, receives) information. A communication unit may communicate using any conventional medium of communication or protocol. A communication unit may send information received from a detector, sent to a component, calculated by a processor, sent or received via a power plant port, or retrieved from a memory. A communication unit may transmit an operational log, provide an error log, receive program code, and provide statistical information about a system that provides a catalyst. A communication unit may transmit a notice from a detector, receive a control signal for a component, or communicate with a power plant computer via a power plant port.

In an implementation, processor 610 executes program code 720 retrieved from memory 620. Processor 610 communicates with memory 620 to store and retrieve information. Processor 610 communicates with sensor input 640, control output 650, power plant port 660, and communication unit 670 via bus 630. Bus 630 may include a local bus, a proprietary bus or a bus utilized by a conventional processor.

Sensor input 640 receives notices from detectors 580-592 via electrical conductors 642. Sensor input 640 provides notices from detectors 580-592 to processor 610. Power plant port receives notices from detectors 550-562. Power plant port may provide notices from detectors 550-562 to processor 610.

Processor 610 analyzes a notice from detectors 580-592 or detectors 550-562. In accordance with the notice, processor 610 may store a notice in an operation log entry (e.g., 710, 712), communicate the notice, send a control signal, request information from a power plant computer, perform a calculation (e.g., maintain statistics), detect an error, and store an error code in an error log entry (e.g., 750, 752).

Processor 610 determines whether to provide a control signal responsive to a notice from detectors 580-592 or 550-562. In the event that processor 610 determines that a control signal should be sent to a component, processor 610 sends information (e.g., code, address) to control output 650. Control output 650 decodes the information and provides a suitable signal to a component via control bus 532. Control output 650 provides the control signal to the component in the form required by the component and with a timing (e.g., protocol) suitable to the component.

Processor 610 may, from time to time, provide information to or receive information from power plant port 660. For example, power plant computer 520 may provide notices from detectors 550-562 to processor 610 via link 534 and power plant port 662.

Communication unit 670 may communicate with an operator of power plant 500, a manufacture of system 510, or a governmental regulatory agency to receive updated program code and provide information calculated by processor 610 or information stored in memory 620. In an implementation, communication unit 670 couples processor 610 to a computer via a USB bus (e.g., 672) and processor 610 provides operational log 710, 712 or error log 750, 752 for analysis by a manufacture of system 510.

Operational log 710, 712 stores information provided (e.g., regular interval, on occurrence of an event, receive of a notice, provision of a control signal) by processor 610. Operational log includes detector notices received and control signals provided indexed by date and time. Operational log 710, 712 may be used to verify provision of a catalyst by system 510. An operation log may have any number of entries up the amount that may be stored in memory allocated for an operation log.

Error log 750, 752 stores information provided by processor 610 about detected errors. Errors may be classified by an error code. Processor 610 may classify an event as an error and store an entry in error log 750. An error log may have any number of entries up the amount that may be stored in memory allocated for an error log.

Processor 610 may calculate statistics relative to the operation of system 510 such as total catalyst provided 760 and hours of operation since refill 770. Processor 610 may gather any information available through sensor input 640, power plant port 660, and communication port 670 and perform any type of calculation (e.g., addition, subtraction, multiplication, division, average, correlation, distribution, variance, covariance, normalization, poisson distribution, permutation, integration, differentiation, laplace transform) to provide a statistic. A statistic may be stored in memory 620.

In operation in one implementation, processing circuit 530 receives information from detector 592 about an amount of catalyst provided to air intake manifold 430. Processor 610 compares an amount of catalyst delivered over time to a threshold amount required for an internal combustion engine of the type of engine 440. In the event that the amount provided is greater than the threshold, processor 610 provides control signals via control output 650 to reduce delivery of catalyst. Control signals to reduce delivery of catalyst may be sent to one or more components of system 510 (100, 200, 300), for example, pump 140 (240) to reduce a magnitude of the increased pressure provided by pump 140, restrictor 120 (220) to reduce a cross area of an orifice that provides flow 146, float 262 to reduce an amount of solution bearing catalyst that is available to atomizer 260, atomizer 160 (260, 360) to reduce an amount of vapor bearing catalyst provided, and metering device 170 (270) to reduce flow of reactant bearing catalyst 174 (274) provided to output 172 (272).

In operation in an implementation, processing circuit 530 receives information from detector 580 of a sudden drop in a magnitude of the pressure inside enclosure 130 (230). In response, processor 610 sends a control signal to metering device 170 (270) to reduce an amount of flow of reactant bearing catalyst 174 (274). Processor 610 monitors detectors 582, 584, and 588 to detect the progress of the decrease pressure of enclosure 130 (230) through system 510 (100, 200, 300). As the pressure throughout system 510 decreases, over time, processor 610 adjusts the amount of flow 174 (274) provided by metering device 170 (270) to account for the lower pressure.

In operation in an implementation, processing circuit 530 receives information from detector 586 as to a fullness of container 150 (250, 350). When an amount of solution reaches a first threshold, processor 610 sends a notice via communication unit 670. If container 150 is not refilled before the solution reaches an second threshold, processor 610 sends a control signal to atomizer 160 (260, 360) via control output 650 to reduce an amount of vapor provided to conserve solution. Upon receiving information from detector 586 that the solution has decrease below a third threshold, processor 610 sends a control signal to disable pump 140 (240) and atomizer 160 (260, 360) to protect them from harm or unnecessary wear.

In operation in an implementation, processing circuit 530 receives notice from detector 552 via computer 520, link 534, and power plant port 660 about the rpm of compressor 414. In response, processing circuit 530 sends an control signal to atomizer 160 (260, 360) or metering device 170 (270) to adjust an amount of catalyst provided.

The foregoing description discusses preferred embodiments of the present invention, which may be changed or modified without departing from the scope of the present invention as defined in the claims. The examples listed in parentheses may be alternative or combined in any manner. The invention includes any practical combination of the structures and method steps disclosed. The words "and" and "or" as used herein shall be construed both conjunctively and disjunctively and each shall include the other (e.g., and/or) whenever practical unless expressly stated otherwise. While for the sake of clarity of description several specifics embodiments of the invention have been described, the scope of the invention is intended to be measured by the claims as set forth below.

What is claimed is:

1. A system for providing a catalyst to a first flow of gas, the first flow of gas having an operating pressure, wherein a pipe carries the first flow of gas from a compressor of a turbocharger to a combustion chamber and the operating pressure of the first flow of gas varies in accordance with an operation of the compressor, the system comprising:

an enclosure that receives a portion of the first flow of gas at the operating pressure;

a pump positioned in the enclosure; and an atomizer; wherein:

the pump receives from within the enclosure the portion of the first flow of gas;

the pump provides the portion of the first flow of gas at a second pressure;

any gas that exits the enclosure is provided by the pump at the second pressure;

the atomizer receives a solution having the catalyst and provides a vapor having the catalyst;

the portion of the first flow of gas at the second pressure carries the vapor out of the system and into the first flow of gas for delivery to the combustion chamber; and a magnitude of the second pressure comprises a magnitude of the operating pressure plus a magnitude of a pressure increase provided by the pump.

2. The system of claim 1 wherein a change in the magnitude of the operating pressure results in a corresponding change in the magnitude of the second pressure.

3. The system of claim 2 wherein:

the corresponding change in the magnitude of the second pressure occurs after a delay; and after the delay the magnitude of the second pressure is greater than the magnitude of the operating pressure.

4. The system of claim 1 wherein while operating at a steady-state the magnitude of the second pressure is greater than the magnitude of the operating pressure by an amount of the pressure increase provided by the pump.

5. The system of claim 1 wherein:

the enclosure receives the portion of the first flow of gas from the pipe a first distance away from the combustion chamber;

the system provides the vapor to the pipe a second distance away from the combustion chamber;

the second distances is closer to the combustion chamber than the first distance.

6. The system of claim 1 wherein the magnitude of the second pressure is greater than zero regardless of a present magnitude of the operating pressure.

7. The system of claim 1 further comprising a bottle that contains the solution, wherein responsive to the second pressure, the bottle provides the solution.

8. The system of claim 1 further comprising a restrictor positioned in an outlet of the pump that restricts the portion of the first flow of gas provided by the pump at the second pressure whereby a rapid decrease in the magnitude of the operating pressure of the first flow results in a less rapid decrease the magnitude of the second pressure.

9. The system of claim 1 further comprising a float valve that controls a flow of solution to the atomizer.

10. The system of claim 1 further comprising a metering device, wherein the metering device meters an amount of the vapor provided to the first flow of gas.

11. The system of claim 1 further comprising:

a metering device; and a detector; wherein:

the detector detects indicia of a position of a throttle; and in accordance with detecting, the metering device meters an amount of the vapor provided to the first flow of gas.

12. The system of claim 1 further comprising:
a first bottle that contains the solution; and
a second bottle that contains the solution; wherein:
responsive to the second pressure, the first bottle provides the solution to the second bottle; and
responsive to receiving the solution from the first bottle; the second bottle provides the solution to the atomizer.

13. The system of claim 1 further comprising a one-way valve positioned between the first flow of gas and the enclosure, wherein:
the valve is open and provides fluid communication between the first flow of gas and the enclosure while the magnitude of the operating pressure of the first flow of gas is greater than or equal to the magnitude of a gas within the enclosure; and
the valve is closed while the magnitude of the pressure of the first flow of gas is less than the magnitude of the gas within the enclosure.

14. The system of claim 1 wherein the atomizer comprises a piezoelectric atomizer.

15. The system of claim 1 wherein the atomizer comprises a mechanical atomizer.

16. A method for providing a catalyst to a first flow of gas, the first flow of gas having an operating pressure, wherein a pipe carries the first flow of gas from a compressor of a turbocharger to a combustion chamber and the operating pressure of the first flow of gas varies in accordance with an operation of the compressor, the system comprising:
receiving a portion of the first flow of gas at the operating pressure;
increasing a pressure of the portion of the first flow of gas to a second pressure;
introducing the catalyst into the portion of the first flow of gas while the portion of the first flow of gas is at the second pressure;
releasing the portion of the first flow of gas having the catalyst into the first flow of gas; wherein:
a magnitude of the second pressure comprises the magnitude of the operating pressure plus a magnitude of the pressure increase.

17. The method of claim 16 wherein introducing comprises:
atomizing a solution containing the catalyst to provide a vapor containing the catalyst; and
mixing the vapor with the portion of the first flow of gas.

18. The method of claim 16 wherein increasing comprises:
receiving into a pump the portion of the first flow of gas; and
providing from the pump the portion of the first flow of gas at the second pressure.

19. The method of claim 16 wherein releasing comprises providing a metered amount of the first flow of gas having the catalyst.

20. A method for providing a catalyst to a first flow of gas, the first flow of gas having an operating pressure, wherein a pipe carries the first flow of gas from a compressor of a turbocharger to a combustion chamber and the operating pressure of the first flow of gas varies in accordance with an operation of the compressor, the system comprising:
detecting a magnitude of the operating pressure;
in accordance with detecting, providing a second flow of gas at a second pressure;
releasing the second flow of gas into the first flow of gas; wherein:
the second flow of gas includes a portion of the first flow of gas;
the second flow of gas includes the catalyst;
a change in the magnitude of the operating pressure results in a corresponding change after a delay in the magnitude of the second pressure; and
after the delay:
the magnitude of the second pressure comprises the magnitude of the operating pressure plus a threshold; and
the magnitude of the second pressure is greater than the magnitude of the operating pressure.

21. A system for providing a catalyst to a first flow of gas, the first flow of gas having an operating pressure, wherein a pipe carries the first flow of gas from a compressor of a turbocharger to a combustion chamber and the operating pressure of the first flow of gas varies in accordance with an operation of the compressor, the system comprising:
a pump that receives a portion of the first flow of gas; and
an atomizer that receives a solution having the catalyst and provides a vapor having the catalyst; wherein:
the pump receives the portion of the first flow of gas;
the pump provides the portion of the first flow of gas at a second pressure;
the portion of the first flow of gas at the second pressure carries the vapor out of the system and into the first flow of gas for delivery to the combustion chamber; and
a magnitude of the second pressure comprises a magnitude of the operating pressure plus a magnitude of a pressure increase provided by the pump.

* * * * *